United States Patent [19]

Hammes

[11] Patent Number: 4,688,140

[45] Date of Patent: Aug. 18, 1987

[54] ELECTRONIC DEFENSIVE WEAPON

[76] Inventor: John Hammes, 5517 Morendo Dr., Las Vegas, Nev. 89107

[21] Appl. No.: 792,137

[22] Filed: Oct. 28, 1985

[51] Int. Cl.[4] ..... F41B 15/04

[52] U.S. Cl. ..... 361/232; 231/2 E

[58] Field of Search ..... 361/232, 235; 273/84 ES; 231/2 E

[56] References Cited

U.S. PATENT DOCUMENTS

| | | | |
|---|---|---|---|
| 4,162,515 | 7/1979 | Henderson et al. | 361/232 |
| 4,424,932 | 1/1984 | Allen | 273/84 X |
| 4,486,807 | 12/1984 | Yanez | 361/232 |

*Primary Examiner*—L. T. Hix
*Assistant Examiner*—D. Rutledge
*Attorney, Agent, or Firm*—Seiler, Quirk & Tratos

[57] ABSTRACT

In an electronic stun gun device comprising a pair of contact probes exposed on opposite sides at the top of a case and a pair of test gap probes extending into a cavity separating the contact probes, the improvement comprises a test gap probe guard means secured adjacent the top of the case and extending along the cavity between the contact probes or test gap probes to prevent an object from entering the cavity to short across the test gap probes.

18 Claims, 18 Drawing Figures

ELECTRONIC DEFENSIVE WEAPON

BACKGROUND OF THE INVENTION

A type of electronic defensive weapon commonly referred to as a "stun gun" has become recently popular because of its immediate effectiveness for temporarily stunning or disabling the person against which it is used while not causing permanent or substantial injury. The weapon, comprises a hand-held and lightweight case having a pair of contact probes across which an arc is created when the device is energized with the probes contacting a subject's body. The device also includes a pair of test gap probes exposed in a cavity extending between the contact probes. These test gap probes, sometimes referred to as inner probes are in electrical contact with the contact probes, but are separated by a closer distance than the contact probes. The test gap probes or inner probes cause a spark discharge for temporarily relieving the high voltage at the output terminals under unloaded conditions. When the device is used against a subject with only the output terminal contact probes contacting the subject's skin, an output of 45,000 to in excess of 50,000 volts is directed to the subject across the contact probes to yield the effective result of the weapon. However, occasionally a subject is contacted such that the subject's arm, leg, or other body portion extends into the cavity and unintentionally simultaneously contacts both test gap probes. If this occurs, when the weapon is energized, because of the shorter gap or distance between the test gap probes, a substantially smaller and relatively ineffective charge is delivered to the subject because of the divided dual current paths thereby greatly defeating or substantially reducing the effectiveness of the device. It is to the elimination of this problem that the present invention is directed.

SUMMARY OF THE INVENTION

In the improved electronic device of the present invention, a means in the form of a test gap probe guard is secured between the contact probes at the upper surface of the case to prevent an enlarged object having a dimension equal to or greater than the distance between the test gap probes from entering the cavity and simultaneously contacting both test gap probes.

DETAILED DESCRIPTION OF THE INVENTION

Figure 1:
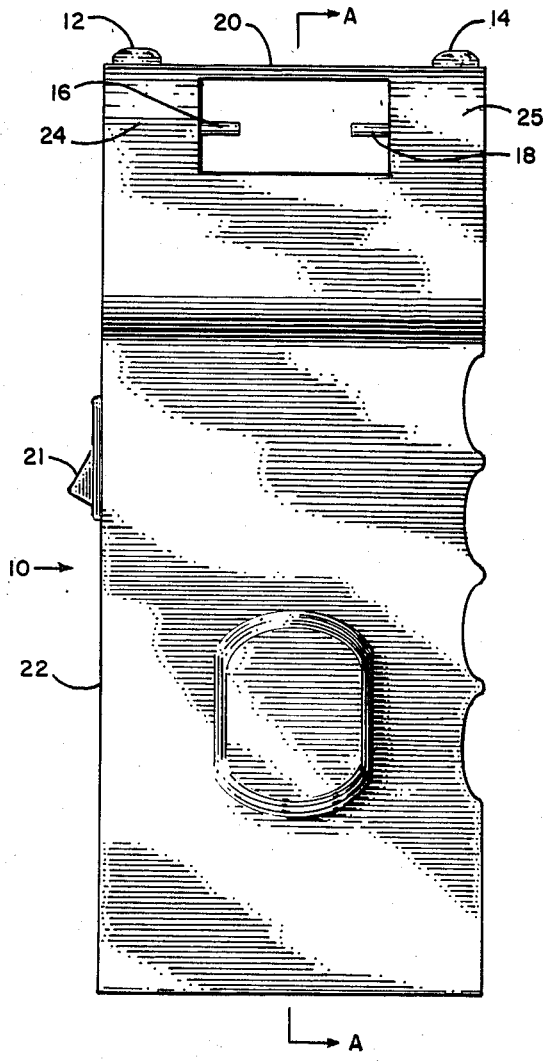
FIG. 1 is a side view of the electronic defensive device of the invention.

As shown in FIG. 1, the electronic defensive device of the invention 10 comprises a case 22 conveniently being of the type for being easily held in the hand of a user. Nominal dimensions for the elongated case are about 6" in height, 2–2½" in width, and a depth of about ¾" in the elongated bottom portion, and about 1¼" in the top portion. The device includes a off-on switch or lever 21, conveniently springloaded, which is depressed for energizing the device during use. When the switch is depressed, a battery, commonly a 9-volt battery, delivers a charge to the basic electronic circuit in the device which produces a pulse utilizing a non-linear relaxation oscillator producing approximately 20 pulses per second. Additional components include a transistor, diodes, and an oscillator transformer. Pulses are produced in the oscillator transformer which creates a charge across a capacitor. Once the arc potential of an internal spark gap is reached, a magnetic field in the oscillator transformer collapses suddenly to create a brief high voltage pulse across the output terminals. Such technology is not part of the invention and is well known to those skilled in the art.

Figure 3:
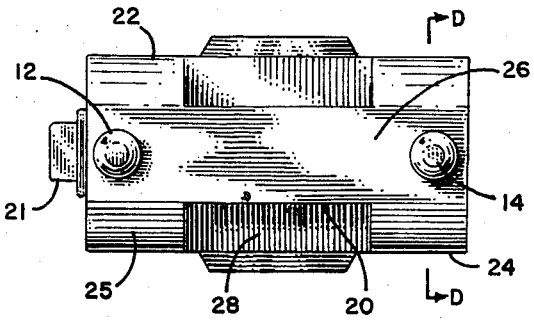
FIG. 3 is a top plan view of the case shown in FIG. 1.
Figure 4:
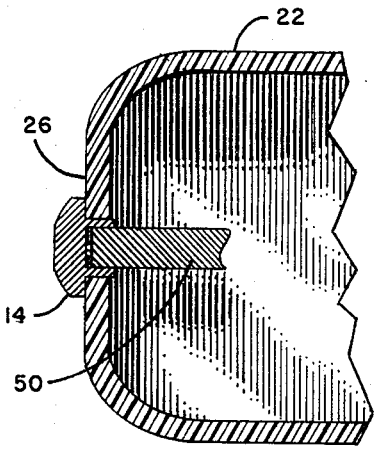
FIG. 4 is an enlarged sectional view of the top portion of a case and contact probe of FIG. 1 taken along lines D—D thereof.

Noting also FIGS. 3 and 4, in the device shown, the output terminals include the contact probes 12 and 14, located at the top of case 22 and exposed and projecting upwardly from the top surface 26. When both contact probes simultaneously touch a subject's skin with the electronic circuit energized, the stunning and temporarily incapacitating effect of the device results. The output terminals also include a pair of test gap probes 16 and 18 which are exposed in a cavity 28, the cavity being depressed or cut out of the top of the case 22 between the contact probes 12 and 14. Such a feature results in two upper and opposite top case portions 24 and 25 above which the contact probes 12 and 14 are exposed, respectively. The cavity is open on both sides of the case. The test gap probes 16 and 18 normally face each other and are exposed into cavity 28 from opposite sides thereof. The test gap probes are separated by a distance which is shorter or smaller than the separation of the contact probes 12 and 14. These test gap probes provide for a spark discharge to relieve the capacitor when the device is not under loaded conditions, i.e., when the device is energized but with no subject or other ground contact across the contact terminals 12 and 14. In the device contact probe separation is commonly about 2 inches while the test gap probe separation is about ¾ inch, although some devices could have test gap probe separations from about ½ to 1 inch. It is to the prevention of objects of such a size from entering the cavity and simultaneously contacting the test gap probes that the present invention is directed.

As previously noted, at present, the devices of this type are designed so that the cavity 28 is open at the top of the case whereby an object may easily extend into the cavity from any direction and simultaneously contact both test gap probes. The disadvantage of such a design is that when the device is to be used against a subject, a portion of the subject's body will inadvertently extend into cavity 28 causing a second path discharge across the closer test gap probes 16 and 18, resulting in much lower penetrative power output to the body area than is normally achieved when only the contact probes 12 and 14 contact the subject. This, in turn, frequently prevents the device from producing the intended effect. To avoid or obviate such a disadvantage, which substantially defeats the purpose of the device, in one embodiment of the invention a closure member 20 in the form of a bar or other type of structure is permanently, or substantially permanently, provided on the case between the two contact probes and across the cavity 28 to prevent an object or a portion of the subject's body to extend into the cavity thereby eliminating an undesirable short of the power discharge through the test gap probes 16 and 18 when the device is energized. In the embodiment illustrated in FIGS. 1, 2, and 3, a bar member 20 is an integrally molded member at the top of the case 22. Such a case is preferably constructed of an impact-resistant plastic, which is conveniently molded with the closure member or bar 20 as a unitary part of the case structure. The bar prevents an object from entering the cavity 28 by passing through a plane extending between the contact probes 12 and 14. The advantage of such a permanent closure member is that the bar cannot be inadvertently removed or dislodged as would occur where the bar was only temporarily clipped on as an aftermarket or add-on structure.

Figure 2:
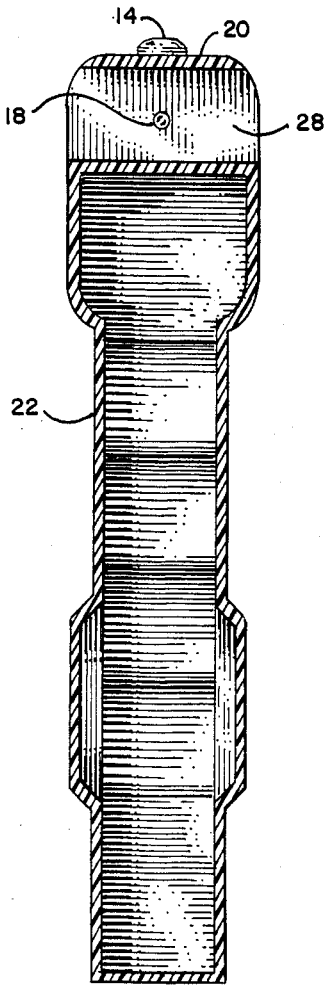
FIG. 2 is a sectional elevation view of the device taken along lines A—A of FIG. 1.
Figure 5:
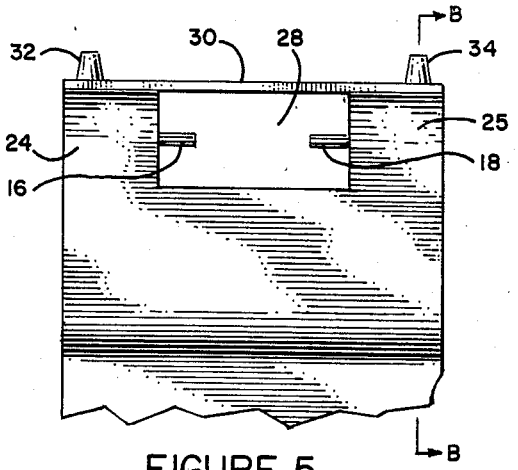
FIG. 5 is a partial side view showing the upper end of a case of the device illustrating another closure member embodiment.
Figure 6:
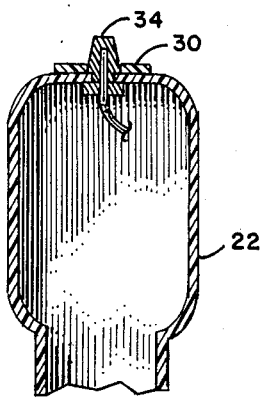
FIG. 6 is a sectional view taken along lines B—B of FIG. 5.

Another embodiment of a similar closure member is shown in FIGS. 5 and 6 in which a bar 30 is secured at the top of the case on opposite top case portions 24 and 25. The bar may be cemented or similarly so secured so that it can not be removed accidentally or inadvertently. Also in the embodiment shown, the contact probes 32 and 34 are elongated and rather narrow as compared to flattened probes 12 and 14 as shown in FIGS. 1 and 2. In FIGS. 5 and 6, the probes extend through and are exposed above the bar 30, the bar again extending entirely across cavity 28 and along a plane extending between the contact probes. An advantage of the bar closure members shown in FIGS. 1–6 is that cavity 28 remains open from both sides of the case. Such a structure allows the cavity to be easily cleaned and removal of material that might cause a short across the test gap probes.

Figure 7:
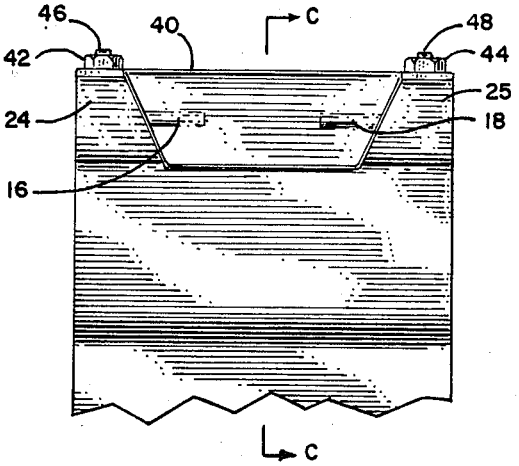
FIG. 7 is a view of the upper end of a case of the device illustrating yet another closure member and contact probe embodiment.
Figure 8:
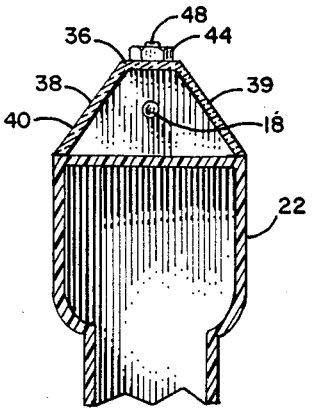
FIG. 8 is a sectional view taken along lines C—C of FIG. 7.

In FIGS. 7 and 8 there is shown yet another closure member embodiment comprising a hood structure 40 which includes in addition to a top portion extending across the top of the device between the contact probes 42 and 44, a pair of side panels or skirts 38 and 39 which extend downwardly so that the closure member substantially encloses cavity 28. The shape of such a hood will depend primarily on the shape of the cavity and the top of the case. Thus, the closure member shape of hood 40 may be modified to accommodate a different cavity and case top shapes. Transparent plastic hood materials through which the interior of the cavity may be viewed are preferred. Different types and shapes of contact probes may also be used. For example, contact probes of FIGS. 7 and 8 include a pair of threaded bolt-type members 46 and 48 on which are threadedly engaged nut-type contact probe components 42 and 44, respectively. Such contact probe components are particularly desirable in securing a bar closure member of the type illustrated in FIGS. 5 and 6 or the hood 40 type of closure member. In such an embodiment, the closure member will include a pair of holes through which the elongated threaded members 46 and 48 extend, the holes being smaller than the nut-type contact probe components 42 and 44 which are then screwed onto the threaded bolt-type components to firmly secure the closure member. Although the shape of the components 42 and 44 are illustrated as nuts, other shapes may be used, including ball shapes, frustoconical shapes, and the like. The important feature is the ease at which the closure member may be fully and easily secured by threadedly engaging the contact probe components until they securely engage the top of the closure member.

Figure 9:
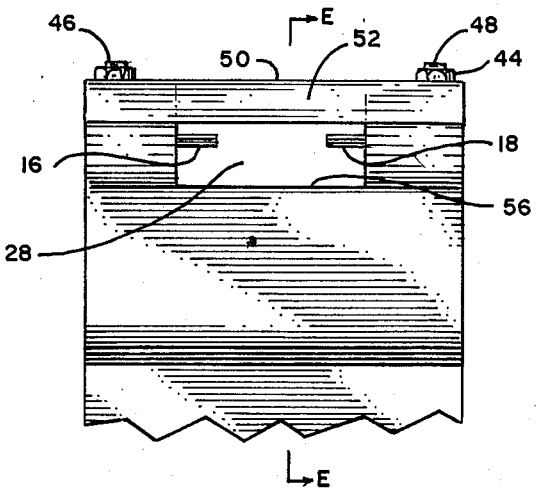
FIGS. 9–18 illustrate still other closure member embodiments of the invention.
Figure 10:
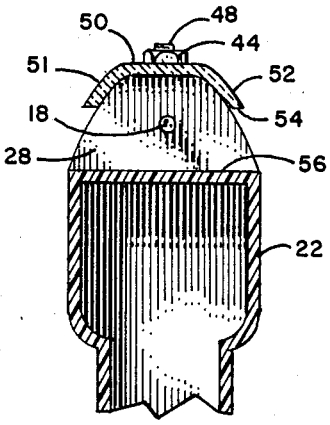
Figure 11:
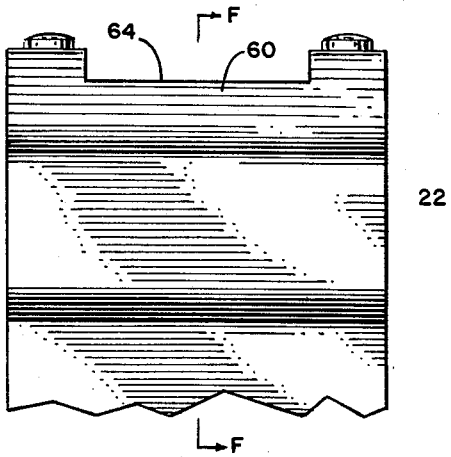
Figure 12:
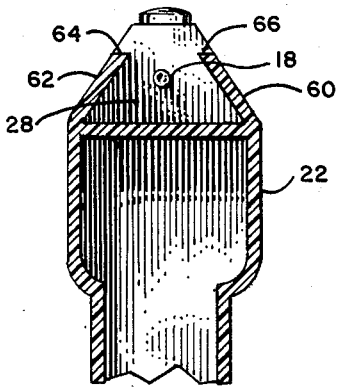

The device illustrated in FIGS. 9 and 10 shows a modification of the embodiments illustrated in FIGS. 5–8. Closure member 50 includes side portions or skirts 51 and 52 extending downwardly toward the floor of the cavity 28 but does not fully enclose the cavity. This feature allows the cavity to be cleaned in a manner similar to the closure member embodiment shown in FIGS. 1–6, but provides somewhat more protection of the test gap probes and reduces cavity exposure since the opening or space between the lower edge 54 of the closure member and floor 56 of the cavity is reduced. Such a device is particularly suitable as an after-market accessory to be installed by an owner of a weapon having removably secured contact probes of the type shown. A pair of holes through which contact probe posts 46 and 48 can be inserted provide for easy installation.

In FIGS. 11–16 there are illustrated additional embodiments of an improvement according to the invention in which means are provided for preventing an object of such sized dimensions which could simultaneously contact both of the test gap probes from entering the cavity. More specifically, such devices prevent an object having a smallest dimension which is equal to or greater than the distance between test gap probes from entering the cavity in which the test gap probes are located. For example, referring again to FIGS. 9 and 10, where the distance between the lower edge 54 of side portion 52 and floor 56 of cavity 28 is less than or smaller than the distance between the test gap probes 16 and 18, the entry of an object having its smallest dimension greater than the distance between the bottom edge of the closure member and the cavity floor will be prevented thereby achieving a desired object of the invention. Similarly, observing the closure member 60 in FIGS. 11 and 12, such a device incorporates the inventive feature whereby the distance between the upper ends 64 and 66 of the closure member are separated by a distance which is less than the distance between the facing ends of test gap probes 16 and 18, shown in phantom in FIG. 11, and accomplishing the desired results. Thus, although embodiments illustrated in FIGS. 9–12 will not entirely restrict objects from entering into the cavity, the inadvertent placement of relatively large objects including body portions such as fingers, wrists, or the like, could not gain entry into the cavity to simultaneously contact both test gap probes.

Figure 13:
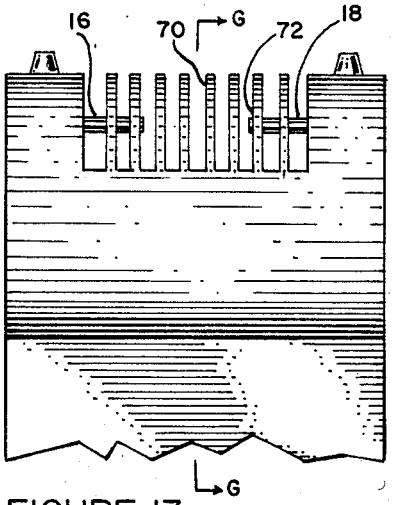
Figure 14:
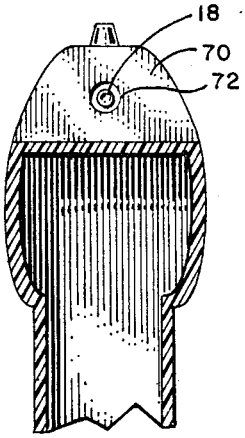
Figure 15:
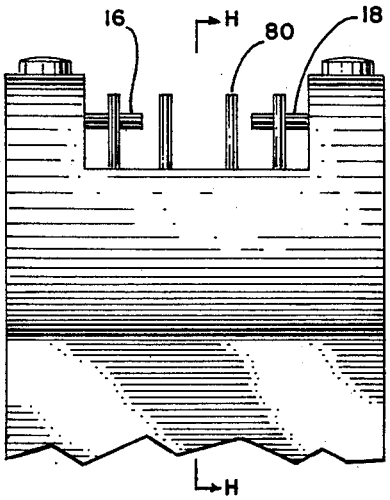
Figure 16:
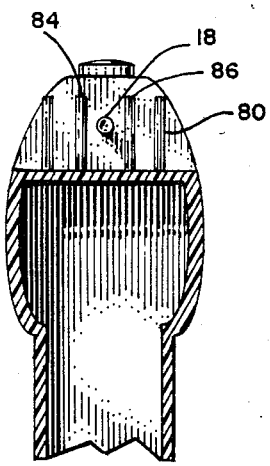

FIGS. 13–16 illustrate yet additional embodiments for preventing relatively large objects having a smallest dimension equal to or greater than the distance between the test gap probes from entering the cavity. Observing the device shown in FIGS. 13 and 14, a plurality of ribs 72 are secured on the floor of the cavity and extend upwardly therefrom to a plane extending across the cavity at an elevation higher than the test gap probes 16 and 18. The ribs may extend across the width of the cavity as shown, although that is not necessary, so long as they extend laterally between the sides of the cavity sufficient to protect the test gap probes. Each of the ribs contain a port 72, also shown in phantom in FIG. 13, which allows for the test spark to cross the cavity between the ends of the test gap probes during testing. However, it will be observed that such a device will not allow an object having a dimension which could short across the test gap probes from entering the cavity. Similarly, in FIGS. 15 and 16, a plurality of ribs in the form of pegs or pins 80, 84, and 86 secured to the floor of cavity 28 extend upwardly to a plane beyond the elevation of the test gap probes, specifically between the test gap probes and the contact probes, thereby preventing an enlarged object from entering the cavity and shorting across the test gap probes. Any number of pins may be used to achieve the desired result, including, for example, pins 84 and 86 adjacent each side of the test gap probes. Again, the closest pins on opposite sides of a test gap probe are to be separated by a dimension which is less than the distance between the test gap probes. The shape of the ribs is not critical so long as they protect the test gap probes from being simultaneously contacted as previously described. Thus, the ribs may be flat as shown in FIGS. 13 and 14, long and narrow as shown in FIGS. 15 and 16, or any other desirable and effective shape.

Figure 17:
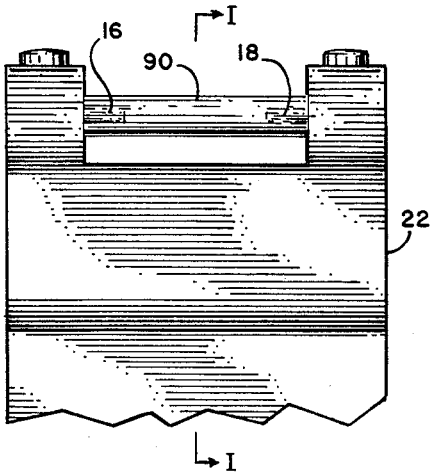
Figure 18:
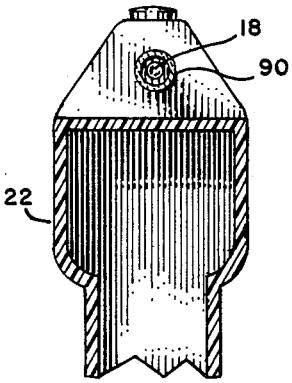

Yet another embodiment of the invention is shown in FIGS. 17 and 18 in which a test gap probe guard means comprises a sleeve 60 for preventing the test gap probes from being shorted by an object entering the cavity. Sleeve 60 is hollow along its length allowing the device to function by a spark passing between the probes during testing. The sleeve 60 is also preferably of a clear rigid plastic which allows the spark to be observed and yet will not melt, sag or otherwise deterioriate or become easily broken or cracked during use. The sleeve must be long enough to cover both ends of the test gap probes and is preferably long enough to simultaneously contact or at least almost touch both sides of the cavity thereby substantially covering both test gap probes. Such a sleeve may be cemented or otherwise secured to the facing sides of the cavity for example using ultrasonic welding. This may be accomplished at the time of manufacture of the device or as an add-on aftermarket component. If the latter, a slot may be provided on the sleeve to allow it to be fitted over the test gap probes during installation.

In FIGS. 1–4 there is also shown more particularly a preferred contact probe 14 which is exposed above the top surface 26 of case 22. This preferred contact probe, shown in cross-section in FIG. 4 along with the electrical conduit 50, is a button-shape, i.e., one in which the cross-sectional vertical dimension of the exposed portion of the probe is less than the horizontal dimension. Thus, the probe is flattened relative to its vertical exposure dimension from or above the top surface 26 of the case 22. Such a preferred probe shape will be effective in contacting a subject's skin, without otherwise injuring either the subject, or even an operator who must use the device. The flattened shape will also be advantageous in preventing eye injuries or causing flesh wounds.

In the device shown in FIG. 3, the dimension and relationship of bar closure member 20 relative to cavity 28 which extends entirely across the top of case 22 and forms a pair of opposite case top portions 24 and 25 from which extend the contact probes 12 and 14 will be noted. By the expression of a plane extending between the contact probes, it is intended to define a plane extending across the top of the device between and through the probes, especially at the location where the probe rests on or meets the top surface shown as 26 in FIG. 4 of the case 22. In the embodiment shown, although the bar covers only a portion of the cavity, it is effective in preventing an object from entering the cavity by passing through a plane extending between the contact probes. The width of the bar may also be expanded to fully cover the cavity, if desired. However, where the test gap probes are both positioned directly below the contact probes which are centered relative to the top of the case, a narrower bar is usually quite adequate.

I claim:

1. An electronic stun gun device comprising a case having first and second contact probes exposed on opposite ends of the top of said case, said contact probes separated by a first distance, a cavity extending through the top of said case and extending across a portion thereof between said pair of contact probes, first and second test gap probes extending into said cavity from opposite sides thereof and separated by a second distance, said second distance being smaller than said first distance, and a closure member secured on said case at the top thereof for preventing an object from entering said cavity by passing through a plane extending between said contact probes.

2. The device of claim 1 wherein said closure member comprises a bar extending across the top of said chamber and secured between said contact probes.

3. The device of claim 2 wherein said bar is formed as an integral part of said case.

4. The device of claim 3 wherein said case is molded plastic and said bar is an integral molded component thereof.

5. The device of claim 1 wherein said contact probes comprise removable cap members and wherein said closure member is secured by said removable cap members.

6. The device of claim 5 wherein said removable cap members are threadedly secured on said device and wherein said closure member is secured on the top of said case under said cap members.

7. The device of claim 6 wherein said closure member comprises a bar extending across the top of said cavity.

8. The device of claim 2 wherein said closure member includes side portions extending from said bar to substantially enclose said cavity.

9. The device of claim 8 wherein said side portions are transparent.

10. The device of claim 2 wherein said closure member includes side portions extending from said bar.

11. The device of claim 7 wherein said closure member includes side portions extending from said bar.

12. The device of claim 1 wherein said closure member comprises a hood for substantially enclosing said cavity.

13. The device of claim 6 wherein said closure member comprises a hood for substantially enclosing said cavity.

14. An electronic stun gun device comprising a case having first and second contact probes exposed on opposite ends of the top of said case, said contact probes separated by a first distance, a cavity extending through the top of said case and extending across a portion thereof between said pair of contact probes, first and second test gap probes extending into said cavity from opposite sides thereof and separated by a second distance, said second distance being smaller than said first distance, and test gap probe guard means positioned in said cavity between said test gap probes for preventing an object equal to or larger than said second distance from contacting both test gap probes simultaneously.

15. The device of claim 14 wherein said cavity includes a floor thereacross below said test gap probes and wherein said test gap probe guard means comprises a plurality of rib members secured in said cavity.

16. The device of claim 15 wherein said rib members are secured along said cavity floor.

17. The device of claim 16 wherein said rib members have one end secured along said cavity floor and another end located between said test gap probes and said contact probes.

18. The device of claim 14 wherein said test gap probe guard means comprises a hollow sleeve extending between said test gap probes and secured thereover.

* * * * *